US006672186B2

(12) United States Patent
Corey

(10) Patent No.: US 6,672,186 B2
(45) Date of Patent: Jan. 6, 2004

(54) METHOD OF MAKING A SINGLE-CELL WINDOW COVERING

(75) Inventor: John A. Corey, Melrose, NY (US)

(73) Assignee: Comfortex Corporation, Watervliet, NY (US)

( * ) Notice: Subject to any disclaimer, the term of this patent is extended or adjusted under 35 U.S.C. 154(b) by 16 days.

(21) Appl. No.: 09/833,381

(22) Filed: Apr. 11, 2001

(65) Prior Publication Data

US 2002/0132090 A1 Sep. 19, 2002

Related U.S. Application Data

(60) Provisional application No. 60/197,063, filed on Apr. 13, 2000.

(51) Int. Cl.[7] ..... B26D 3/00; E06B 3/48

(52) U.S. Cl. ..... 83/13; 160/84.05

(58) Field of Search ..... 83/177, 13; 52/793.1, 52/793.11, 786.11; 160/84.05; 428/178, 181; 156/197, 204, 227, 250, 291

(56) References Cited

U.S. PATENT DOCUMENTS

| | | | | |
|---|---|---|---|---|
| 2,689,387 A | * | 9/1954 | Carr | 160/90 |
| 3,533,894 A | * | 10/1970 | Engelbrecht et al. | 428/118 |
| 4,288,485 A | | 9/1981 | Suominen | |
| 4,450,027 A | | 5/1984 | Colson | |
| 4,631,217 A | | 12/1986 | Anderson | |
| 4,677,886 A | * | 7/1987 | Neu | 82/53 |
| 4,861,404 A | * | 8/1989 | Neff | 156/204 |
| 5,193,601 A | | 3/1993 | Corey et al. | |
| 5,313,998 A | * | 5/1994 | Colson et al. | 160/84.02 |
| 5,482,750 A | * | 1/1996 | Colson et al. | 428/12 |
| 5,543,198 A | * | 8/1996 | Wilson | 428/116 |
| 5,630,898 A | | 5/1997 | Judkins | |
| 5,837,084 A | * | 11/1998 | Barss | 156/197 |
| 5,974,763 A | * | 11/1999 | Colson et al. | 52/793.1 |
| 6,052,966 A | * | 4/2000 | Colson et al. | 52/793.1 |
| 6,068,039 A | * | 5/2000 | Judkins | 160/84.05 |
| 6,435,784 B2 | * | 8/2002 | De Mattia et al. | 409/132 |

FOREIGN PATENT DOCUMENTS

| | | | | |
|---|---|---|---|---|
| JP | 04057675 A | * | 2/1992 | B24C/5/02 |

* cited by examiner

*Primary Examiner*—Allan N. Shoap
*Assistant Examiner*—Isaac Hamilton
(74) *Attorney, Agent, or Firm*—Rader, Fishman & Grauer PLLC

(57) ABSTRACT

A method of forming a single-cell column type of multi-cellular collapsible window covering from a starting product in the form of a double-cell column type of multi-cellular honeycomb structure. The individual cells of the starting product are defined by external pleated sides on the opposite faces of the structure and internal ligaments interconnecting the opposite faces at spaced intervals. Selected internal ligaments are severed, while leaving others of the internal ligaments intact, thereby eliminating one of the original columns of cells.

21 Claims, 8 Drawing Sheets

METHOD OF MAKING A SINGLE-CELL WINDOW COVERING

CROSS NOTING TO RELATED APPLICATIONS

This application claims the benefit of provisional patent application Serial No. 60/197,063, filed on Apr. 13, 2000.

BACKGROUND OF THE INVENTION

1. Field of the Invention

This invention relates to an improved method for making single-cell honeycomb type window coverings.

2. Description of the Related Art

In the past, single-cell honeycomb type window coverings have been made by a variety of techniques. One technique, disclosed in U.S. Pat. No. 4,450,027 to Colson, involves folding a continuous strip of fabric into a tube, applying adhesive to the exterior of the tube and then winding the tube onto a rotating rack so that the adjacent windings of the stacked tube are bonded together to form a honeycomb array or stack of cells of single-cell thickness. Another technique, disclosed in U.S. Pat. No. 4,288,485 to Suominen and U.S. Pat. No. 5,630,898 to Judkins, cuts through the full depth of a collapsed multiple-cell width honeycomb array of cells to remove a single-cell width column of cells.

SUMMARY OF THE INVENTION

The method of the present invention begins with a previously formed multiple-cell width honeycomb array of cells. Only selected internal ligaments are severed to form either a single-cell width product or a product wherein the stack of cells includes both multiple-cell width portions and single-cell width portions.

DESCRIPTION OF THE PREFERRED EMBODIMENT

In the preferred embodiment of the invention, the starting product is a multiple-cell width honeycomb array of cells formed by the process disclosed in U.S. Pat. No. 5,193,601 to Corey et al., the entire contents of which is herein incorporated by reference. The process disclosed in the '601 patent results in the multiple-cell width honeycomb, collapsible, fabric product 10 shown, in simplified example form, in FIG. 1.

Figure 1:
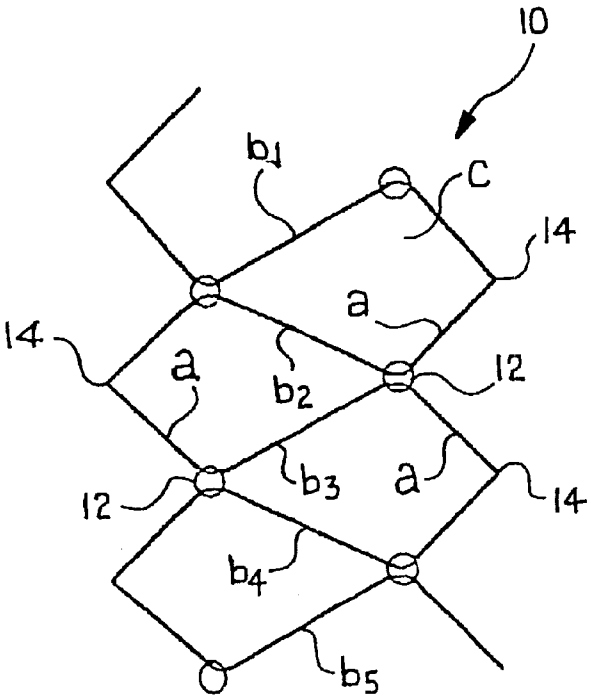
FIG. 1 (Prior Art)
FIG. 1 is an illustration of the prior art disclosed by Corey et al.

As shown in FIG. 1, the starting product 10 is illustrated in a Type 1:1 configuration. The reader may readily see that passing an imaginary horizontal plane (of the Type 1:1) through a bonding or glue line 12 (shown schematically as a circle) and crease 14, a single cell C will be traversed, passing through the crease 14. Passing a second imaginary plane through an adjacent glue line 12 and crease 14 will traverse, again, a singular cell C. Thus, this type of configuration is 1:1.

The reader is advised in the manner of making the starting product 10 of FIG. 1. As described in the '601 patent, the process of making the staring product 10 begins with a web, i.e., a continuous fabric, a single adhesive stripe is applied between each pre-established index for a fold, substantially closer to the open side of the proposed fold than the closed side. In appearance, a pair of adhesive stripes straddles a crease, each line equidistant from the crease and on the surface of the web that will be exposed to view. The flexibility of the web material and the functioning of fold lines or creases as permanent hinge lines permit the tubular cells to be readily and non-destructively collapsed and expanded along an axis parallel to the length of the original web as the window covering is raised and lowered, respectively, during use. Pleated sides or external ligaments a are parts of the web appearing between bonding lines 12 and creases 14; and internal ligaments b are ligaments of the web appearing only between bonding lines 12. The term "line" is used simply because, to the untrained eye, the adhesive appears to be nothing more than a (barely) discernible line of a coating material. But, it is the character of appropriate adhesives to stiffen when fully cured and thereby impart to the web an integral, transverse structural element.

Figure 2B:
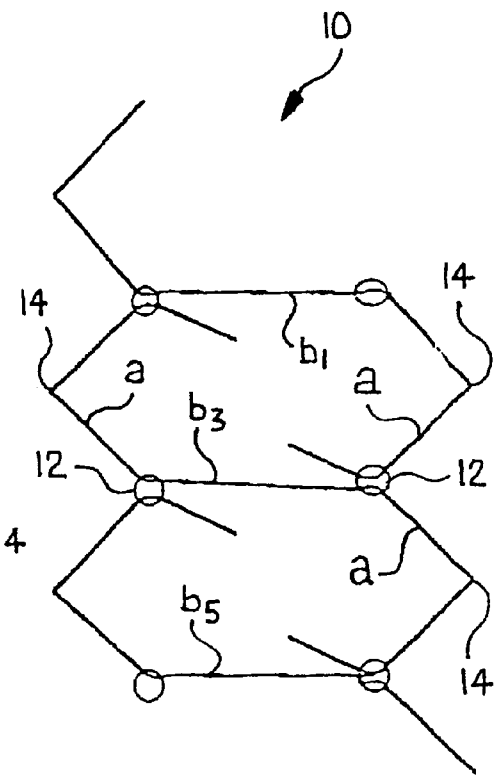
FIGS. 2*a* and 2*b* illustrate a plan view of the product of FIG. 1 after the internal ligaments have been severed in accordance with a first embodiment of the invention.
Figure 2A:
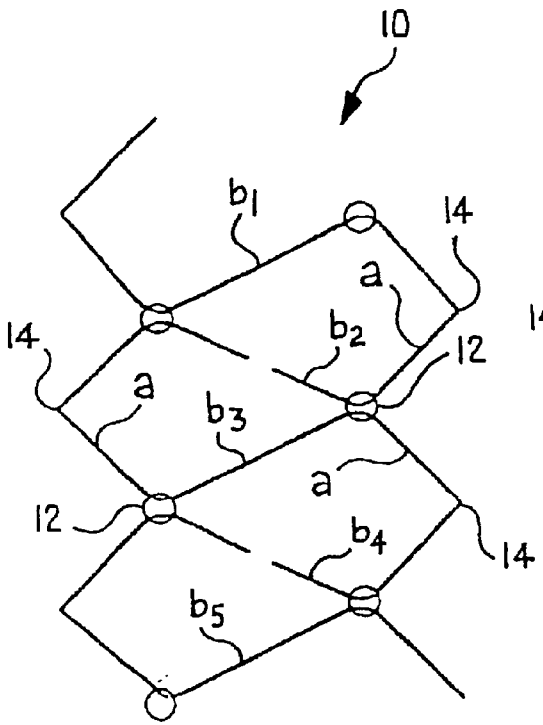

FIG. 2*a* shows the starting product 10 of FIG. 1 after selected internal ligaments b have been severed. Specifically, alternate internal ligaments $b_{2,4}$ are severed, resulting in the uniform-pitch finished product 10 of FIG. 2*b*. In this embodiment, each cell has only a single pleat on each face. The process FIG. 2*a* is presently preferred, because the resulting product of FIG. 2*a* has pleated faces of uniform pitch. It will be apparent that the severed internal ligaments b may either be the "descending" internal ligaments $b_{2,4}$, as shown in FIG. 2*a*, or the "ascending" internal ligaments $b_{1,3,5}$, provided that only alternating internal ligaments are severed.

Figure 3A:
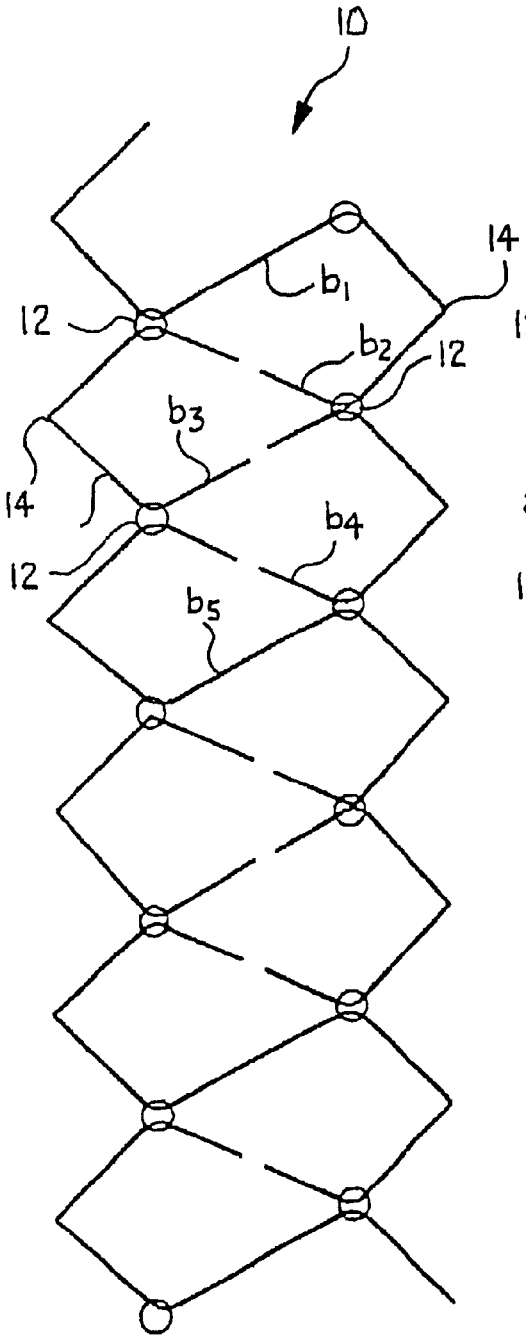
FIGS. 3*a* and 3*b* illustrate a plan view of the product of FIG. 1 after the internal ligaments have been severed in accordance with a first alternate embodiment of the invention.
Figure 3B:
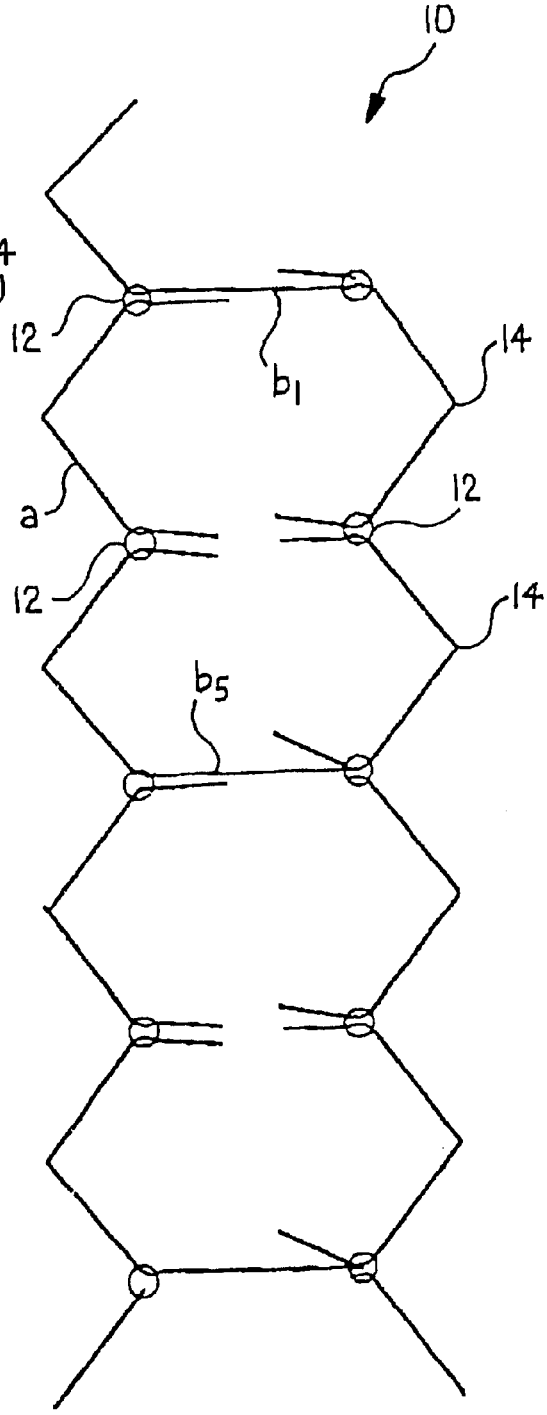

A first alternative embodiment is shown in FIG. 3*a*, wherein three consecutive, adjacent internal ligaments $b_{2,3,4}$ are severed, leaving every fourth internal ligament $b_{1,5}$ intact. In other words, every internal ligament b is severed, except every fourth internal ligament $b_{1,5}$ is left intact. This sequence results in the finished product 10 of FIG. 3*b*. As evident from FIG. 3*b*, each cell has two pleats on each face.

Figure 4A:
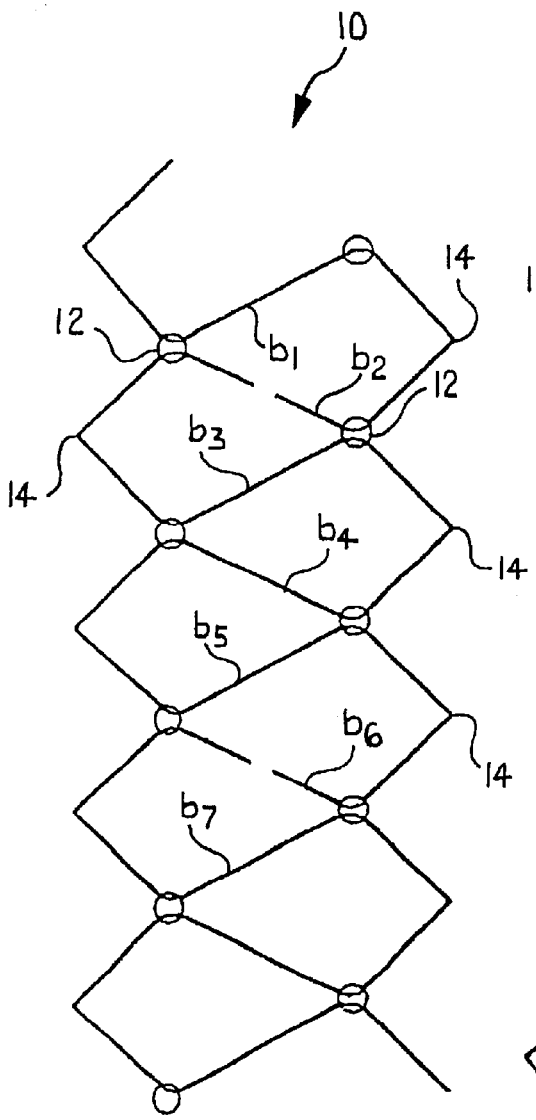
FIGS. 4*a* and 4*b* illustrate a plan view of the product of FIG. 1 after the internal ligaments have been severed in accordance with a second alternate embodiment of the invention.
Figure 4B:
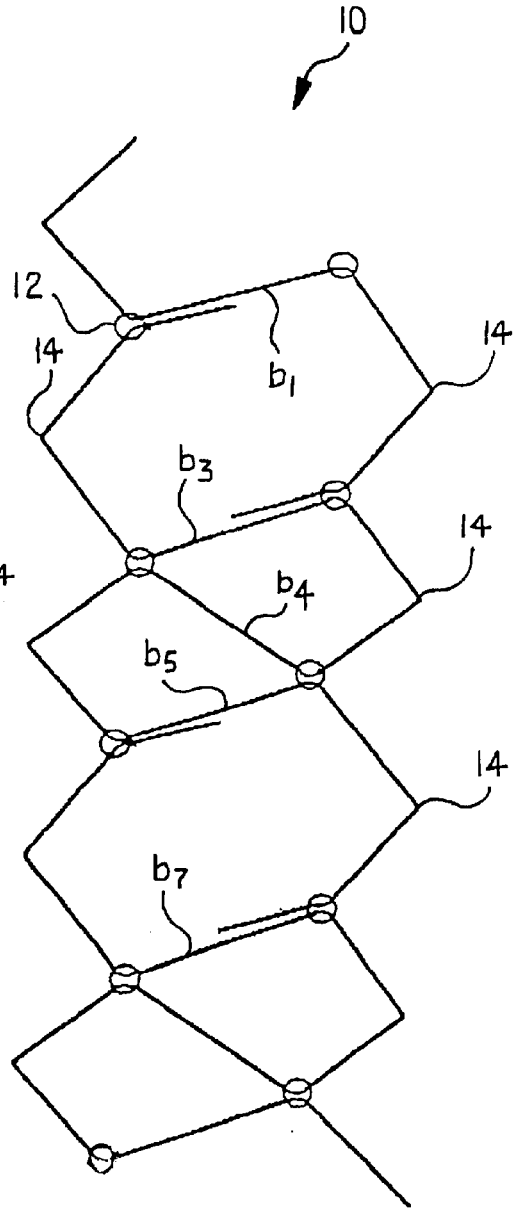

Other alternatives result in pleated faces having non-uniform pitch, which may not be preferred for aesthetic reasons. In the method of FIG. 4*a*, the sequence is to cut one internal ligament $b_2$, leave the next three internal ligaments $b_{3,4,5}$ intact, etc. In other words, every fourth internal ligament $b_{2,6}$ is severed. This sequence results in the finished product 10 of FIG. 4*b*, wherein each face has a single pleat per cell, but the pleats have an alternating variable pitch resulting from the inclusion of a pair of the original, unmodified, double-cell cells remaining between each newly formed single-cell.

Figure 5A:
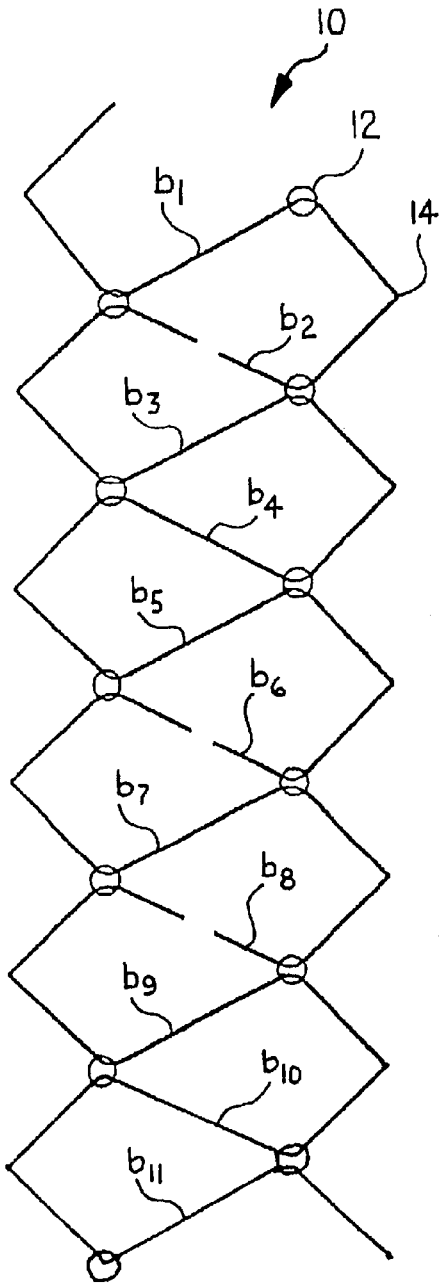
FIGS. 5*a* and 5*b* illustrate a plan view of the product of FIG. 1 after the internal ligaments have been severed in accordance with a third alternate embodiment of the invention.
Figure 5B:
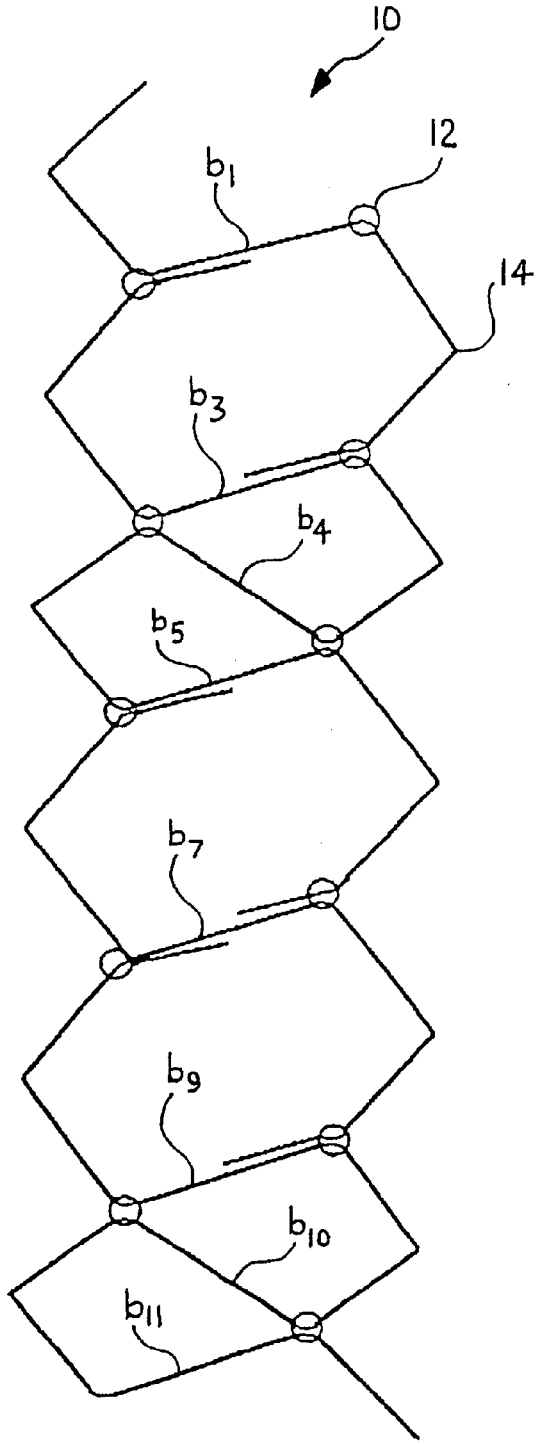

A further modification involves a variation of the cut one internal ligament, leave three, cut one, leave three sequence, etc. of FIG. 4*a*. In FIG. 5*a*, the sequence is to cut one internal ligament $b_6$, leave one internal ligament $b_7$ intact, cut one internal ligament $b_8$, leave the next three internal ligaments $b_{9,10,11}$ intact, etc. This sequence results in the finished product 10 of FIG. 5*b*, wherein two adjacent single-cells (rather than only one single-cell as in FIG. 4*b*) appear between each original double-cell.

Figure 6A:
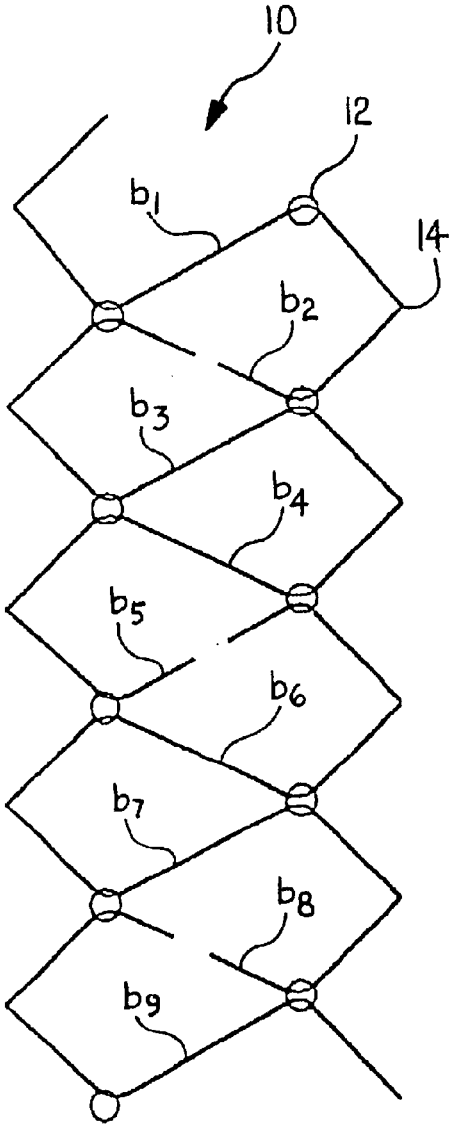
FIGS. 6*a* and 6*b* illustrate a plan view of the product of FIG. 1 after the internal ligaments have been severed in accordance with a fourth alternate embodiment of the invention.
Figure 6B:
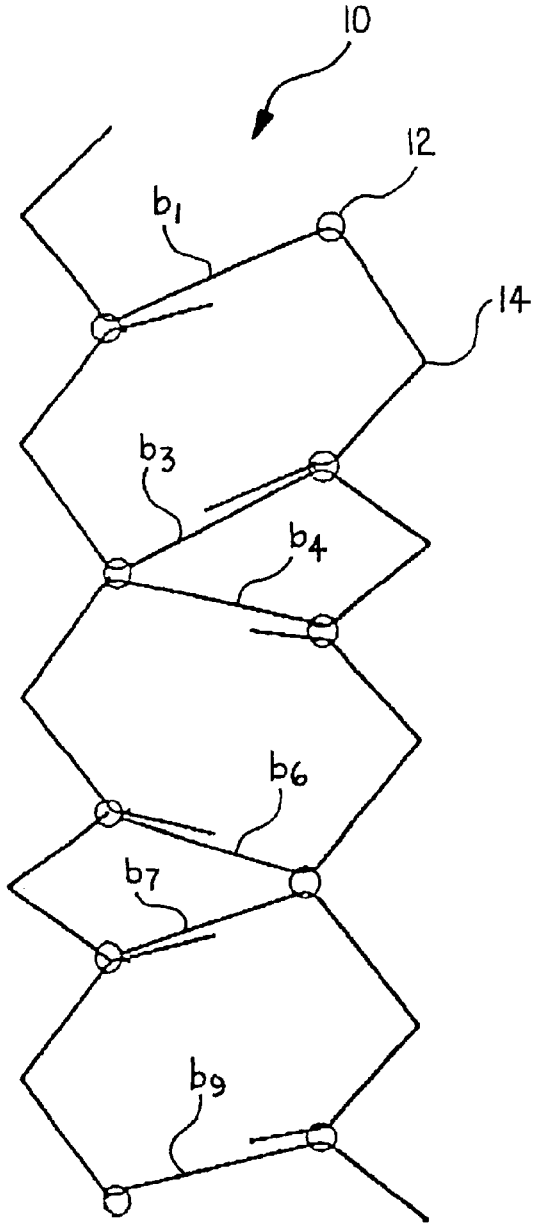

Another alternative method is shown in FIG. 6*a*, involving the simple alternating sequence of cut one internal ligament $b_2$, leave two internal ligaments $b_{3,4}$, cut another internal ligament $b_5$, leave two internal ligaments $b_{6,7}$, cut another internal ligament $b_8$, leave two internal ligaments $b_{9,10}$, etc. In other words, every third internal ligament $b_{2,5,8}$ is severed. This sequence results in the finished product 10 of FIG. 6*b*, wherein only half of an original double-cell pair appears between each newly formed single-cell, and such half double-cells appear on alternating faces of the finished product 10.

Figure 7A:
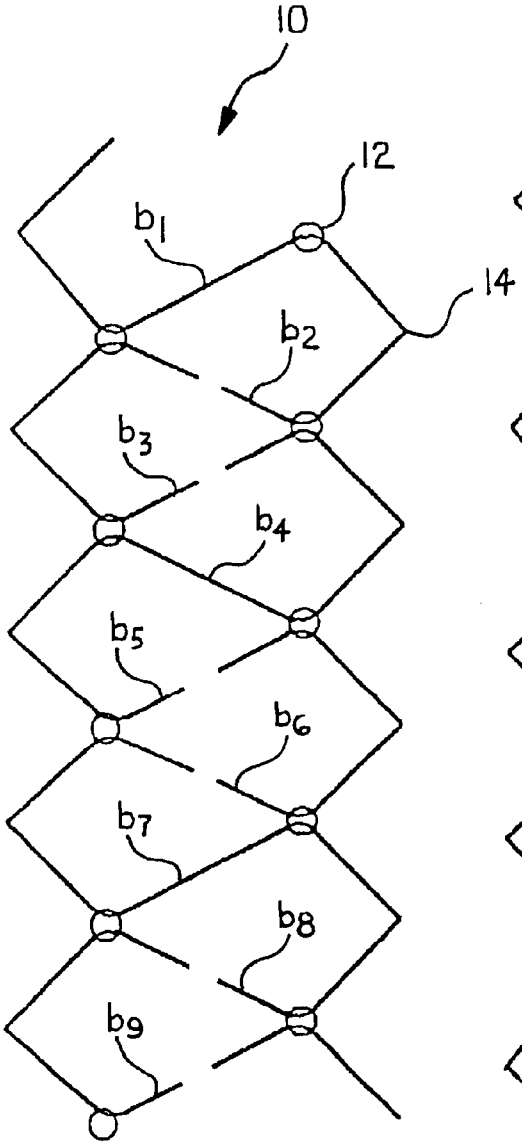
FIGS. 7*a* and 7*b* illustrate a plan view of the product of FIG. 1 after the internal ligaments have been severed in accordance with a fifth alternate embodiment of the invention.
Figure 7B:
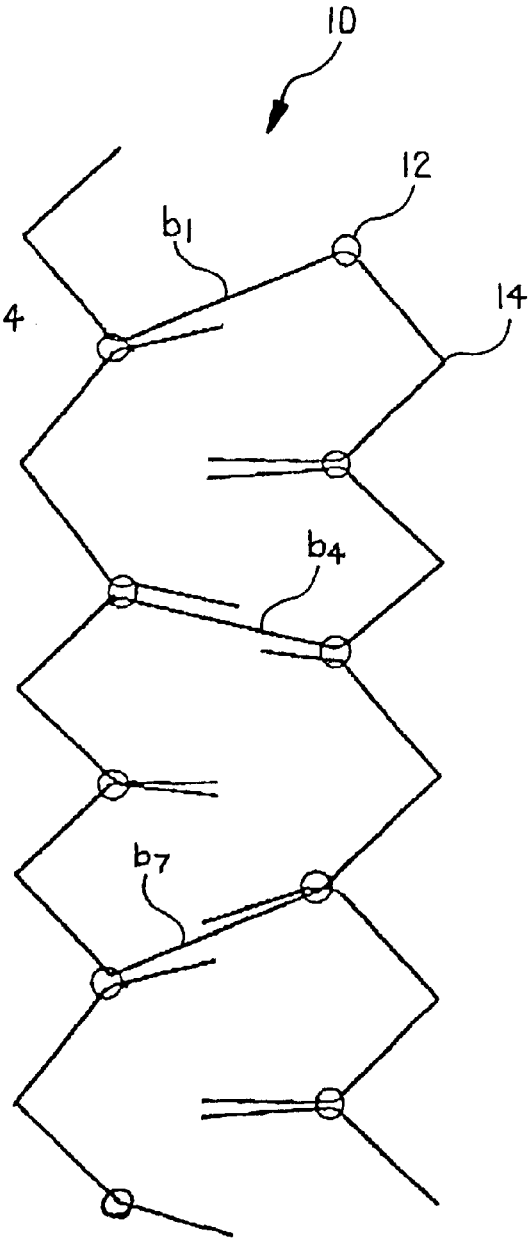

Still another alternative method is shown in FIG. 7*a*, involving the simple alternating sequence of cut two internal ligaments $b_{2,3}$, leave one internal ligament $b_4$, cut two internal ligaments $b_{5,6}$, leave one internal ligament $b_7$, cut two internal ligaments $b_{8,9}$, etc. In other words, every internal ligament is severed, except every third internal ligament is left intact. This sequence results in the finished product 10 of FIG. 7*b*, wherein each newly formed cell has a single pleat on one face and a double pleat on the opposite face, and such cells are oriented in alternating opposite directions.

The location of the glue lines 12 shown in the accompanying drawings is such that they are spaced apart from each other at approximately the one-third and two-third points in the width of the flattened product, i.e., as viewed in the accompanying drawings. The fact that ligaments b are to be severed in accordance with the processes of the present invention, the product 10 may be designed so that the internal ligaments b are initially made shorter than the width of the product 10. For example, the internal ligaments b can be made shorter than one-third the width of the product 10. This modified configuration can be accomplished by decreasing the spacing between the glue lines 12 of each ligament-defining pair.

Figure 8:
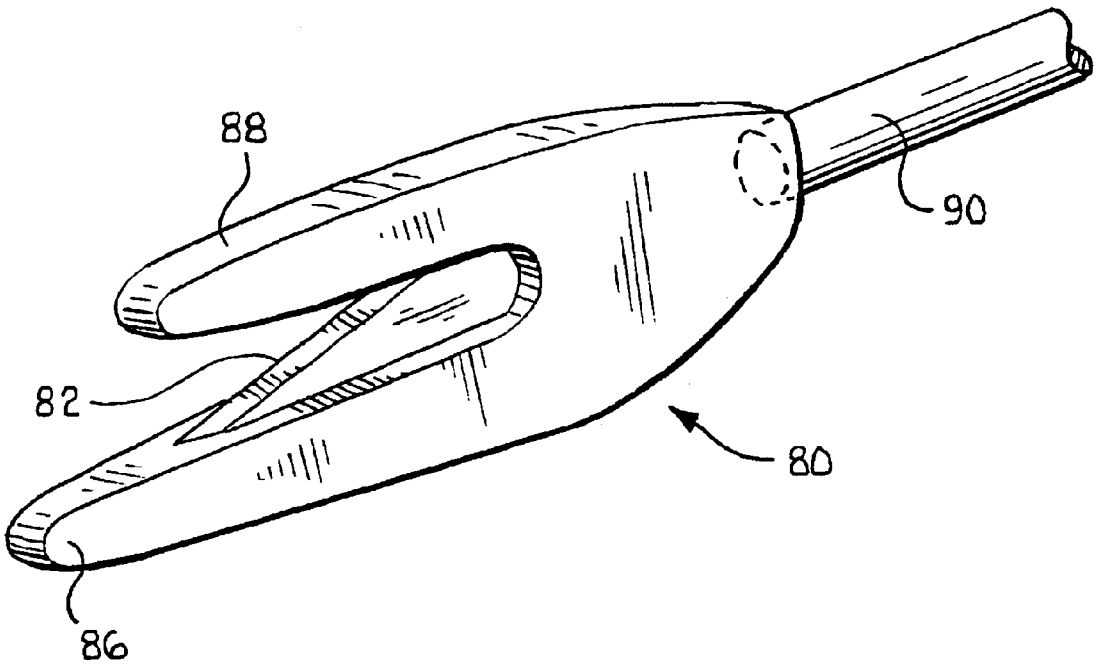
FIGS. 8 and 9 illustrate a means for severing the ligaments in accordance with the invention.
Figure 9:
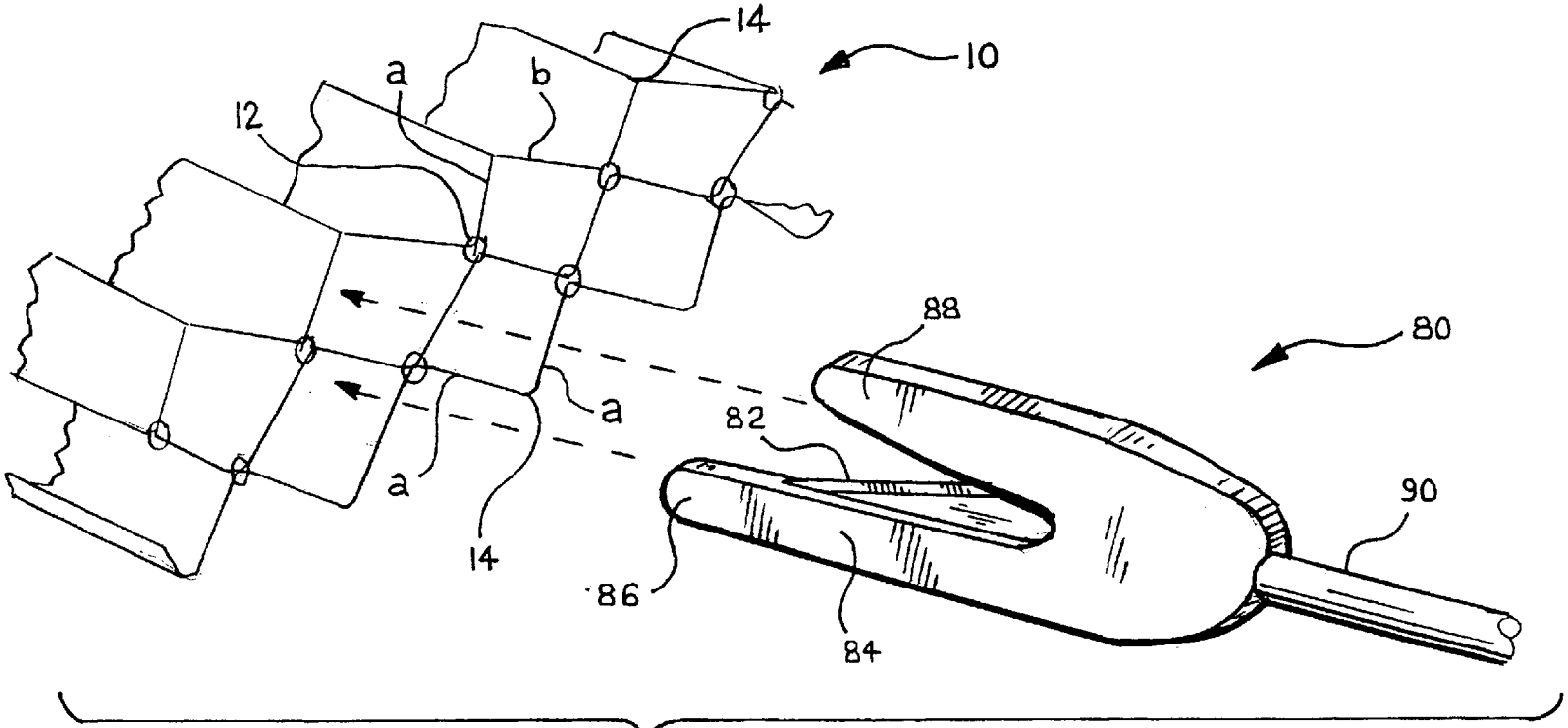

Referring now to FIGS. 8 and 9, the severing of the desired internal ligaments b is accomplished by advancing a cutting means, such as a knife blade, shown generally at 80, through the longitudinal length of the product 10. The knife blade 80 includes a blade 82 that is mounted at an angle 84 between a pilot finger 86 and a guard finger 88. Preferably, the pilot finger 86 projects further ahead of the knife blade 80 than the guard finger 88. The knife blade 80 can be mounted on the end of a rod 90 that is preferably actuated by a reciprocating means (not shown).

The knife blade 82 is advanced toward and into the cellular structure of the product 10, its path being substantially parallel to the longitudinal axis L of the cells. The pilot and guard fingers 86, 88 of the knife blade 80 straddle the desired ligament or septum to be cut. The cross-sectional dimensions of the pilot finger 86 and blade 82 are selected relative to the cell perimeter to assure that the cell entered by the pilot finger 86 goes tight (or flat) over the exposed blade 82, to assure proper severing of the desired ligament. It is contemplated that two properly spaced knife blades may be mounted on the reciprocating means, so that, in the case of the embodiment of FIG. 2 (where alternating ligaments are severed), two ligaments may be severed by a single stroke of the two-blade cutting means. Following the cutting and withdrawing strokes of the knife blades, the product 10 could be indexed the appropriate distance to bring the next pair of ligaments to be cut into proper alignment with the reciprocation path of the cutting blades of the two-blade cutting means.

As an alternative to severing the desired ligaments b by cutting, as disclosed above, it may be desirable to establish pre-weakened severance lines in the desired locations, as by perforating the fabric, preferably prior to the pleating step. Thus, when the pleated, glued, and cured product is complete, it may be expanded in a direction to expand the cells to the point that the ligaments, which go tight first because of their length relative to that of the pleated faces, will be tensioned sufficiently to break or separate along the pre-perforated lines.

As will be understood by those skilled in the art, other sequences or patterns of cutting can be conceived without departing from the present concept of cutting the selected internal ligaments described above. For example, the principles of the invention can be applied to a starting product that is a multi-celled column type window covering.

While the invention has been specifically described in connection with certain specific embodiments thereof, it is to be understood that this is by way of illustration and not of limitation, and the scope of the appended claims should be construed as broadly as the prior art will permit.

SEQUENCE LISTING

The patent contains a lengthy "Sequence Listing" section. A copy of the "Sequence Listing" is available in electronic form from the USPTO web site (http://seqdata.uspto.gov/sequence.html?DocID=6672186B2). An electronic copy of the "Sequence Listing" will also be available from the USPTO upon request and payment of the fee set forth in 37 CFR 1.19(b)(3).

What is claimed is:

1. A method of forming a window covering from a starting product in the form of a multiple-columned honeycomb structure, wherein the individual cells of the starting product are defined by external pleated sides on the opposite faces of the structure and internal ligaments interconnecting such opposite faces at spaced intervals and serving as a partition between adjacent cells of different columns of cells, the method comprising the steps of:

severing selected ones of the internal ligaments, while leaving others of the internal ligaments intact, thereby eliminating at least one of the individual cells of the starting product.

2. The method according to claim 1, wherein alternating internal ligaments are severed.

3. The method according to claim 1, wherein the internal ligaments are severed, except every fourth internal ligament is left intact.

4. The method according to claim 1, wherein every fourth ligament is severed.

5. The method according to claim 1, wherein one internal ligament is severed, an adjacent internal ligament is intact, the next adjacent internal ligament is severed, and the next adjacent three internal ligaments are left intact, and such severing pattern is then repeated for successive cells of the structure.

6. The method according to claim 1, wherein every third ligament is severed.

7. The method according to claim 1, wherein the internal ligaments are severed, except every third internal ligament is left intact.

8. A method of forming a multi-cellular collapsible window covering from an starting product in the form of a double column type of multi-cellular honeycomb structure, wherein the individual cells of the starting product are defined by external pleated sides on the opposite faces of the structure and internal ligaments interconnecting such opposite faces at spaced intervals and serving as a partition between adjacent cells of different columns of cells, the method comprising the steps of:

severing selected ones of the internal ligaments according to a predetermined repeating sequence, while leaving others of the internal ligaments intact, thereby eliminating at least one of the individual cells of the starting product.

9. The method according to claim 8, wherein the predetermined sequence produces a finished product wherein each cell has only a single pleat on each face of the finished product.

10. The method according to claim 8, wherein the predetermined sequence produces a finished product wherein each cell has two pleats on each face of the finished product.

11. The method according to claim 8, wherein the predetermined sequence produces a finished product wherein each face has a single pleat per cell and the pleats have an alternating variable pitch on the finished product.

12. The method according to claim 8, wherein the predetermined sequence produces a finished product wherein two adjacent single-cells appear between each original double-cell of the finished product.

13. The method according to claim 8, wherein the predetermined sequence produces a finished product wherein only half of an original double-cell pair appears between each newly formed single-cell, and such half double-cells appear on alternating faces of the finished product.

14. The method according to claim 8, wherein the predetermined sequence produces a finished product wherein each newly formed cell has a single pleat on one face and a double pleat on the opposite face, and such cells are oriented in alternating opposite directions on the finished product.

15. A method of forming a multi-cellular collapsible window covering from an starting product in the form of a multiple-columned honeycomb structure of a Type 1:1 configuration, wherein the individual cells of the starting product are defined by external pleated sides on the opposite faces of the structure and internal ligaments interconnecting such opposite faces at spaced intervals and serving as a partition between adjacent cells of different columns of cells, the method comprising the steps of:

severing selected ones of the internal ligaments, while leaving others of the internal ligaments intact, thereby eliminating at least one of the individual cells of the starting product.

16. The method according to claim 15, wherein alternating internal ligaments are severed.

17. The method according to claim 15, wherein the internal ligaments are severed, except every fourth internal ligament is left intact.

18. The method according to claim 15, wherein every fourth ligament is severed.

19. The method according to claim 15, wherein one internal ligament is severed, an adjacent internal ligament is intact, the next adjacent internal ligament is severed, and the next adjacent three internal ligaments are left intact, and such severing pattern is then repeated for successive cells of the structure.

20. The method according to claim 15, wherein every third ligament is severed.

21. The method according to claim 15, wherein the internal ligaments are severed, except every third internal ligament is left intact.

* * * * *

UNITED STATES PATENT AND TRADEMARK OFFICE

CERTIFICATE OF CORRECTION

PATENT NO. : 6,672,186 B2
DATED : January 6, 2004
INVENTOR(S) : John A. Corey

It is certified that error appears in the above-identified patent and that said Letters Patent is hereby corrected as shown below:

Columns 5 and 6,
Before the claims please delete the Sequence Listing heading and paragraph.

Signed and Sealed this

Twenty-seventh Day of April, 2004

JON W. DUDAS
*Acting Director of the United States Patent and Trademark Office*